US010244824B2

(12) United States Patent
Hwang et al.

(10) Patent No.: US 10,244,824 B2
(45) Date of Patent: Apr. 2, 2019

(54) HEEL PROTECTOR

(71) Applicant: GOGO HEEL, LLC, Encinitas, CA (US)

(72) Inventors: Grace Hwang, Encinitas, CA (US); Nicolas Zadno, Encinitas, CA (US)

(73) Assignee: GOGO HEEL, LLC, Encinitas, CA (US)

( * ) Notice: Subject to any disclaimer, the term of this patent is extended or adjusted under 35 U.S.C. 154(b) by 29 days.

(21) Appl. No.: 15/087,580

(22) Filed: Mar. 31, 2016

(65) Prior Publication Data

US 2016/0278483 A1 Sep. 29, 2016

Related U.S. Application Data

(63) Continuation of application No. 13/210,219, filed on Aug. 15, 2011, now Pat. No. 9,301,575.

(51) Int. Cl.

| | |
|---|---|
| ***A43B 13/22*** | (2006.01) |
| ***A43C 13/00*** | (2006.01) |
| ***A43B 21/437*** | (2006.01) |
| ***A43B 21/26*** | (2006.01) |
| ***A43B 21/52*** | (2006.01) |
| ***A43C 15/04*** | (2006.01) |

(52) U.S. Cl.

CPC ..... *A43C 13/00* (2013.01); *A43B 21/265* (2013.01); *A43B 21/437* (2013.01); *A43B 21/52* (2013.01); *A43C 15/04* (2013.01)

(58) Field of Classification Search

CPC ..... A43B 21/42; A43B 21/433; A43B 21/52; A43B 7/144; A43B 13/186; A43B 13/34; A43B 23/30

USPC ..... 36/72 B

See application file for complete search history.

(56) References Cited

U.S. PATENT DOCUMENTS

| | | | |
|---|---|---|---|
| 1,039,306 | A | 9/1912 | McDonald |
| 1,053,361 | A | 2/1913 | Cummings |
| 1,261,525 | A | 4/1918 | Helwitz |
| 1,263,555 | A | 4/1918 | Helwitz |
| 1,422,446 | A | 7/1922 | Kaplan |
| 1,439,104 | A | 12/1922 | Helwitz |

(Continued)

FOREIGN PATENT DOCUMENTS

| | | | |
|---|---|---|---|
| DE | 3006116 | A1 | 2/1982 |
| EP | 0 388 366 | A2 | 9/1990 |

(Continued)

OTHER PUBLICATIONS

Plastics International—Polypropylene Homopolymer, https://www.plasticsintl.com/datasheets/Polypropylene_Homopolymer.pdf, downloaded Apr. 13, 2015.

(Continued)

*Primary Examiner* — Timothy K Trieu

(74) *Attorney, Agent, or Firm* — Knobbe Martens Olson & Bear LLP

(57) ABSTRACT

A shielding cup is provided for use with a self-fusing member or collapsible heat-concentrating accessory. The shielding cup is attached to a shoe heel as a temporary fix for a worn heel tip. The cup can be attached to the heel by a self-fusing member that binds to itself. The cup can also be attached by using a heat source and collapsible heat-concentrating accessory to concentrate heat on the heat-shrink version of the shielding cup.

17 Claims, 3 Drawing Sheets

(56) References Cited

U.S. PATENT DOCUMENTS

| | | | | |
|---|---|---|---|---|
| 1,663,622 | A | 3/1928 | Atkinson | |
| 1,875,806 | A | 9/1932 | Givens | |
| 1,964,049 | A | 6/1934 | Giannini et al. | |
| 2,875,532 | A | 3/1959 | Fitzsimmons | |
| 2,875,534 | A * | 3/1959 | Grossman | A43B 3/166 36/72 B |
| D192,994 | S | 6/1962 | Klein | |
| 3,053,357 | A | 9/1962 | Stanger | |
| 3,089,786 | A | 5/1963 | Nachtsheim et al. | |
| 3,094,793 | A | 6/1963 | Werke | |
| 3,122,848 | A | 3/1964 | Grossman | |
| 3,142,910 | A | 8/1964 | Levine | |
| 3,150,453 | A | 9/1964 | Tilden | |
| 3,152,408 | A | 10/1964 | Frank | |
| 3,222,801 | A | 12/1965 | Mostertz | |
| 3,439,435 | A | 4/1969 | Fredon | |
| 3,608,213 | A * | 9/1971 | Jensen | A43B 13/34 36/34 R |
| 4,461,100 | A | 7/1984 | Minor et al. | |
| 4,750,278 | A | 6/1988 | Cates | |
| D301,182 | S | 5/1989 | Girardat et al. | |
| 4,848,008 | A | 7/1989 | Kuehnle | |
| 5,044,097 | A | 9/1991 | Young | |
| 5,052,129 | A | 10/1991 | Lobasso et al. | |
| 5,058,290 | A | 10/1991 | Koehl | |
| 5,311,675 | A | 5/1994 | Topel | |
| 5,573,213 | A | 11/1996 | Henderson et al. | |
| 6,635,516 | B1 | 10/2003 | Komatsu | |
| 6,895,695 | B1 | 5/2005 | Chen | |
| D591,033 | S | 4/2009 | Patterson et al. | |
| 7,578,075 | B1 | 8/2009 | Kemp | |
| 7,644,719 | B2 | 1/2010 | Galanty | |
| 7,730,638 | B2 | 6/2010 | Urbach et al. | |
| 8,033,035 | B2 | 10/2011 | Brown et al. | |
| 8,453,351 | B1 | 6/2013 | Hale | |
| 2007/0152110 | A1* | 7/2007 | Fong | G06F 3/03543 248/118 |
| 2008/0060226 | A1 | 3/2008 | Rie | |
| 2008/0148606 | A1 | 6/2008 | Brown | |
| 2008/0184598 | A1 | 8/2008 | Handel et al. | |
| 2008/0196279 | A1 | 8/2008 | Epping | |
| 2008/0216363 | A1* | 9/2008 | Alexander | A43B 1/0027 36/72 B |
| 2009/0077757 | A1 | 3/2009 | Tameno et al. | |
| 2009/0165337 | A1 | 7/2009 | Cohen | |
| 2009/0217553 | A1 | 9/2009 | Jagger | |
| 2009/0282702 | A1 | 11/2009 | Brown | |
| 2011/0185601 | A1 | 8/2011 | Hampton | |
| 2011/0232137 | A1 | 9/2011 | Desiderio | |
| 2013/0042505 | A1 | 2/2013 | Hwang | |
| 2014/0033579 | A1 | 2/2014 | Greener | |
| 2014/0250736 | A1 | 9/2014 | Zadeh | |
| 2014/0259803 | A1 | 9/2014 | Reardon | |
| 2016/0249708 | A1 | 9/2016 | Boag | |

FOREIGN PATENT DOCUMENTS

| | | | |
|---|---|---|---|
| EP | 0479254 | A3 | 4/1992 |
| EP | 0980655 | A2 | 2/2000 |
| GB | 1298662 | A | 12/1972 |
| GB | 2171590 | A | 9/1986 |
| GB | 2217177 | A | 10/1989 |
| GB | 2419800 | A | 5/2006 |
| GB | 2428177 | | 1/2007 |
| JP | 2000070005 | A | 3/2000 |
| JP | 2006034882 | A | 2/2006 |

OTHER PUBLICATIONS

Office Action from co-pending U.S. Appl. No. 15/586,751, filed May 4, 2017, dated Oct. 18, 2018.

* cited by examiner

HEEL PROTECTOR

CROSS-REFERENCE TO RELATED APPLICATIONS

This application is a continuation of U.S. application Ser. No. 13/210,219, filed on Aug. 15, 2011, entitled "HEEL PROTECTOR," which is incorporated by reference herein in its entirety.

BACKGROUND OF THE INVENTION

Field of the Invention

This application is directed to an apparatus and method for attaching an accessory to a shoe heel and more particularly is directed to attaching a replacement for a worn stiletto heel tip.

Description of the Related Art

Stiletto heels are commonly worn for fashion, as part of professional business attire, or by persons seeking additional height. These high heel shoes have a relatively narrow lower heel and a heel tip (also referred to as heel lift, dowel lift, or top piece). The heel tip is attached to the bottom of the heel post for protection against the severe abrasive pressure on the heel during normal walking. To securely fasten the heel tip to the heel, a nail stem is driven into a bore extending along the heel post. Various types of heel tips have been devised, but at the present time, conventional heel tips consist of a hard rubber part molded around a metal nail head with the nail stem protruding beyond the rubber material.

A large amount of stress and pressure is concentrated on a heel tip from the impact against the ground, especially when walking on uneven or high-friction surfaces such as concrete. Such forces, coupled with the small surface area of the heel, often cause heel tips to wear out and require frequent replacement. Worn out heel tips are an "in-the-moment" problem that continually plague shoe wearers who wear stiletto heels. Heel tip replacement, the most acceptable solution, is not an instant fix mainly because it requires pulling out the worn heel tip. Although repair at home is possible, most stiletto heel wearers do not have the equipment or expertise to perform this repair without damaging the heels and thus are compelled to take these heels to a shoe repair professional. Professional repair can take several days or a week or more. If an individual forgets to take the stiletto heel in for professional repair (or does not leave enough time for processing), the heels will either not be available or the individual will be stuck with the adverse side effects of worn out heel tips at an inopportune time. The general process of getting heel tips professionally replaced can be a hassle and big source of frustration, especially for those with a tight schedule.

Presently, a simple, instant fix for a worn out heel tip is not available to consumers. Consequently, many people delay replacement and continue to walk on worn out heel tips, sometimes wearing heels away completely until remnants of the metal nail are all that remain. Walking on worn out heel tips involves a variety of adverse side effects. First, the metal nail head can mark, scrape, and generally damage floors. Second, the metal nail head is slippery and increases the risk of sliding on smooth surfaces while walking on such surfaces. The heel tip serves as a protective buffer between the heel post, generally comprising of a vulnerable plastic material, and the ground. As a result, walking on a worn out heel tip can completely wear down the protective hard rubber layer surrounding the metal nail head, exposing the heel post to fraying, erosion, and other damage from friction. Lastly, the exposed metal nail makes a loud, distinct clicking sound as it strikes the ground during walking. This is often viewed as unprofessional in a business environment while being generally bothersome and embarrassing.

Women that work in a more formal business setting commonly wear shoes with a stiletto heel on a daily or regular basis as part of their workplace attire. Due to the frequency of wear, the issue of worn heel tips is a common problem for this group of women. With no quick and easy fix presently available, coping with worn heel tips is especially inconvenient during tightly scheduled business trips that often require being in transit, running around in airports, walking, and standing more than usual. With increased walking and standing, the loud sound of the metal nail head hitting the ground is more noticeable. This sound is distracting and projects an unprofessional image. Aside from the sound, worn out heel tips can result in a visibly unsightly appearance, as the heel post and heel fabric start to noticeably fray with continued wear.

Most commonly, there are instances when women forget to bring their shoes in for a heel tip replacement and are then stuck with the adverse side effects of worn out heel tips at an inopportune time, such as a business trip or a special occasion. This can be a very frustrating revelation with no easy fix.

There is record of prior attempts to create devices and methods for repairing heel tips. These inventions fall into two categories: 1) a reconstruction of the heel tip and heel post, mostly aimed at shoe manufacturers and focused on providing an improved mode of replacing worn heel tips without special skills or tools and 2) temporary support devices that attach to heel tips primarily designed to protect the heel tip from uneven or soft surfaces and likewise protect the floor or other soft surfaces against dents and damage from heel tips, with the most notable feature being a larger, wider base for delivering support and distributing force.

The first category of heel repair is not well adapted for use by consumers without specialized skills. The second category consisting of temporary heel tip attachments has been unsuccessful for a variety of reasons or are cumbersome and noticeable due to the large base. Additionally, the primary function of these prior art cases is different from the embodiments of the present invention, subsequently leading to inherently different designs.

SUMMARY OF THE INVENTION

What is presently unavailable and needed is an easy, quick solution for consumers that can offer immediate gratification, for example by providing an instant temporary fix for a worn out heel tip. This solution should be an auxiliary and/or new replacement heel tip either for temporary or permanent attachment directly over the worn heel tip. It will not require disturbing the shoe's existing structure, making the burdensome task of removing the worn heel tip unnecessary and obsolete for temporary fixes. The solution should be inexpensive for consumers, durable to resist a high friction environment, easy to apply, discreet, and should securely attach to the heel tip without the need to necessarily remove the nail or without becoming loose and falling off during use.

The embodiments discussed and within the scope of this application relate to attachable shoe accessories that serve as an auxiliary and/or new replacement heel tips that may be quickly and easily applied over the worn heel tip of a stiletto heel to avoid both the burdens of heel replacement and the adverse side effects resulting from walking on a worn out heel tip. The primary objective of the embodiments is to provide a novel solution that is easy and intuitive to apply, portable, discreet in appearance, durable for at least a short period of time, and securely anchored under a heel during normal walking. One challenge is finding a quick and effective attachment device or method. Some of the embodiments address the issue of attaching a protective device to a limited surface area that can mostly consist of a metal nail. It also provides a solution for protecting the heel from a large concentration of pressure and force. The embodiments reside not in any one feature, but rather in the particular combinations of all of them herein disclosed and claimed. The basic elements of certain embodiments of this invention are a durable shielding cup and a device or method for securely attaching the cup over the worn heel tip such that it can withstand the immense abrasive pressures generated during normal walking. Embodiments of this invention protect the heel without disturbing the existing structure of the shoe. In one embodiment, a shielding cup provided for attaching to a stiletto heel serves as a replacement heel tip that may be quickly and easily applied over the worn heel of a stiletto high heel to avoid or defer for some period of time both the burdens of replacement and the adverse side effects resulting from walking on a worn out heel tip. The shielding cup can comprise one or more of a high-density polyethylene, polyurethane, polycarbonate, acrylonitrile butadiene styrene (ABS), or any abrasion resistant material known to those skilled in the art. The walls of the cup can have a lower durometer than the base of the cup. In such embodiments, the walls are more flexible to accommodate different heel sizes. The cup may be attached to the heel by one or more layers of adhesive covering the inner cavity of the cup. This embodiment can be instantly applied anywhere without any special tools or skills, and it would provide an instant layer of protection between the worn heel tip and ground. Additionally, the cup preferably is configured to be discreet once applied. The existing nail or the heel tip may or may not be removed for this solution.

In another embodiment, the shielding cup is attached to the heel by using an elongated self-fusing member and/or adhesives to wrap around the cup and heel to bind them together. Like the first embodiment, this embodiment can be instantly applied anywhere without any other tools or prior knowledge, and it would provide an instant layer of protection between the worn heel tip and ground. Additionally, the cup and self-fusing member can be fashioned to be discreet once applied.

More particularly, the shielding cup is made of a durable, abrasion-resistant material, such as a high durometer polyurethane or a composite such as two polymers or a polymer-metal combination. The side walls can have a lower durometer than the base to allow for more flexibility in the side walls. Additionally, the cup can have features to accommodate different heel sizes and provide for easier insertion or attachment of the heel. These include, but are not limited to, a plurality of steps within the cup, a friction-enhancing surface on the exterior side walls of the cup, slits on the side walls, an adhesive lining within the cup, and an open top with a wider inner perimeter than the heel base. The walls of the cup can also be tapered to make it less noticeable when attached. Tapering can be provided in several ways. For example, the walls can taper or be inclined toward the center of the cup. One can consider this a tapering of the width or profile of the cup. In some embodiments, the thickness of the walls taper, e.g., the walls are thicker toward the bottom and thinner near the top. The walls also can be inclined and have tapering wall thickness in some embodiments. Also, the walls can taper in a non-uniform fashion along the walls such that, for example, one portion (e.g., one-half) of the cup can have a different degree of taper than another portion (e.g., one-half). Other techniques could be applied to provide better adhesion to various heel sizes. One can increase the heel diameter by wrapping some tape or pour polymers around the heel or inside the cup to take any slack between the heel and the cup.

The shielding cup is attached to an exposed heel to temporarily, or for an extended period of time, protect it from wear. This is accomplished by inserting the heel into the open top of the cup. After the cup is applied, the side walls of the cup should cover the sides of the heel but not extend over the entire heel.

An elongate self-fusing member can wrap around the heel tip area before the cup is attached to fill in any empty space between the cup and a smaller sized heel tip. Additionally, the elongate self-fusing member can be attached to securely bind the cup to the heel. The self-fusing member is stretched and contracted around a portion of the cup and heel. The cross-linking property of the self-fusing member activates when exposed to a catalyst. This allows the member to self-fuse in one minute or less.

In another embodiment, the shielding cup is made of a thermoplastic material and is attached by a heat-shrink method, heat, and/or adhesives to attach the cup to the heel. This embodiment requires a hot air hair dryer (also referred to as blowdryer) or a similar heat source for application. By using a blowdryer and collapsible heat-concentrating accessory to direct heat to the shielding cup, the thermoplastic material shrinks and conforms to the shape and size of the worn out heel tip. Although the application time would be short, this embodiment would be an "at home" solution rather than an "on the go" solution.

In particular, in one embodiment the side walls can have a lower durometer than the base which allows for more flexibility in the side walls. Additionally, the cup can have features to accommodate different heel sizes and provide for easier insertion or attachment of the heel. These include, but are not limited to, a plurality of steps within the cup, an adhesive lining within the cup, and an open top with a wider inner perimeter than the heel base. The walls of the cup can also be tapered to make it less noticeable when attached. For example, the walls can be inclined toward the center of the cup, e.g., making the cup wider at the base and narrower at the rim. Also, or alternatively, the cup can have tapered (or varying thickness) walls.

This embodiment has heat-shrink properties that allow it to constrict by at least a ratio of 2:1. The heat-shrink cup is attached to an exposed heel to temporarily protect it from wear. This is accomplished by inserting the heel into the open top of the cup. After the cup is applied, the side walls of the cup should cover the sides of the heel but not extend over the entire heel. The cup is then attached by a heat-shrink method utilizing off-the-shelf nozzles or heat source or more custom designs such as a collapsible heat-concentrating accessory.

Various materials could be used in the construction of the different embodiments. The structure configured to shrink can include a heat-shrink thermoplastic material. In particular, the heat-shrink cup can be manufactured from a thermoplastic material such as polyolefin, fluoropolymer (such as FEP, PTFE or Kynar), PVC, neoprene, silicone elastomer or Viton. The thermoplastic parts could be reinforced with another material such as a metal or another polymer. The shielding cup can have a composite structure with the lower part being harder than the upper section. This can be achieved either mechanically by creating a tapered structure, cuts or ridges in the walls of the cup, or molding and joining two dissimilar plastics or materials together. Such materials could be polycarbonates, nylon, acetal, polyurethane, silicone, Pebax™, rubber or other materials with similar properties. The adhesives could be natural or synthetic, binding by use of a solvent that evaporates or a chemical reaction between two or more constituents.

In another embodiment, a heat-shrink embodiment of the cup is attached using a heat source and collapsible heat-concentrating accessory. The accessory has a narrow opening that is adapted for holding a stiletto heel and a wider opening adapted for directing heat toward the narrow opening. The narrow opening has a screen base and a plurality of holes above the base that serve to direct heat. Once the heat-shrink cup with the heel inserted is placed on the screen base, a heat source is placed into the wider opening and used to heat the cup. The heat source should reach a temperature of at least 60 degrees Celsius while heating the cup. The cup attaches to the heel by shrinking and conforming to the shape and size of the heel.

The embodiments of the inventions are highly functional for their intended purpose and are designed to be discreet by emulating the appearance of a heel tip. Furthermore, they can be manufactured at a low cost. Other combinations of materials or shrink tubing and various kinds of an elongate member could also be used.

In some variations, an apparatus that attaches to a stiletto or other heel to cover an exposed heel is provided. The apparatus includes a shielding cup and an elongate member. The shielding cup has a bottom base of durable, abrasion-resistant material, side walls extending away from the bottom base to an open top that serves as the receiving end of the cup. The open top has an outer perimeter not substantially smaller than the perimeter of the bottom base. When applied to the heel tip, the side walls of the cup enclose the sides of the heel without extending over the entire heel. The elongate self-fusing member has a first end and a second end and can comprise a crossed-linked material that stretches and contracts. When portions of the self-fusing member are brought into contact while the elongate member is stretched, the contacting portions bind together to create a substantial force transverse to the heel to secure the shielding cup to the heel. In one case, a zone of overlap between the first end and to the second end is provided upon contact. The zone of contact can be a short length near the first and second ends or a longer length approaching or exceeding the length of the perimeter of the heel tip.

In some variations, an elongate member can be configured to take up or fill a space between the shielding cup and the heel. In further variations, an elongate member can be configured either to take up space or to secure the shielding cup to the heel. For example a first length of the elongate member can be positioned between the cup and the heel while a second length can be used to secure the cup to the heel.

In another embodiment, a method for repairing a stiletto heel is provided. The stiletto heel includes a heel tip disposed at the end of a heel post. The heel post has a first end coupled with the stiletto shoe and a second end adjacent to the tip. In the method, a shielding cup is provided, the cup having a bottom base of durable, abrasion-resistant material, side walls extending away from the bottom base to an open top. The open top has an inner perimeter and an outer perimeter not substantially smaller than the perimeter of the bottom base. The shielding cup is placed over the heel tip, or over the heel tip and a portion of the heel post such that the heel tip is covered and the open top is disposed between the first and second end of the heel post. The placement of the cup can be such that the open top is at a location closer to the second end of the heel post than the first end of the heel post.

Thereafter, in some embodiments, heat is applied to the shielding cup to cause the shielding cup to shrink and conform to the shape and size of the heel, e.g., to the heel post in the vicinity of the open top, to securely connect the shielding cup to the heel. The shielding cup provides a replacement heel tip.

In other variations of the method, a spacer is positioned between an inner surface of the side walls and an outer surface of the heel to improve the fit therebetween. Thereafter, the cup can be secured to the heel, e.g., by applying heat or by positioning an elongate member on one or both of the heel and the cup. As discussed below, the elongate member can be a self-fusing member or an adhesive member.

In another embodiment, an apparatus is provided that attaches to a stiletto heel to temporarily cover an exposed or worn heel. The apparatus includes a shielding cup having a bottom base of durable, abrasion-resistant material and side walls extending away from the bottom base to an open top. The open top serves as the receiving end of the cup. The open top has an inner perimeter greater than the outer perimeter of the heel base and an outer perimeter not substantially smaller than the perimeter of the bottom base. The shielding cup comprising a structure configured to shrink to cause at least the open top to constrict by at least a ratio of 2:1 in a direction transverse to the heel. When the shielding cup is applied to the heel tip, the side walls of the cup enclose the sides of the heel without extending over the entire heel.

BRIEF DESCRIPTION OF THE DRAWINGS

The structures and methods of using certain embodiments of the inventions will be better understood with the following detailed description of embodiments of the invention, along with the accompanying illustrations, in which.

DETAILED DESCRIPTION OF THE PREFERRED EMBODIMENT

Figure 1:
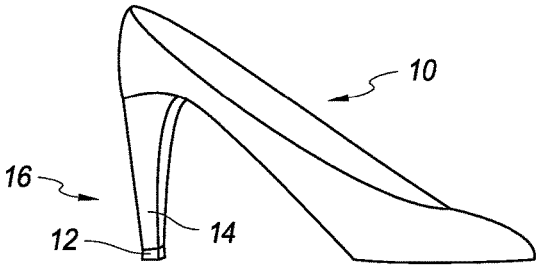
FIG. 1 is a representation of a high heel stiletto shoe.

FIG. 1 represents a stiletto shoe 10 of conventional construction. The heel 16 of the shoe comprises of a heel post 14, which can be covered by a fabric layer, and a heel tip 12. The heel tip 12 is typically made of a hard rubber material such as polyurethane and is secured to the heel post 14 by a metal nail 28 (see FIG. 3A) that is embedded in the rubber material. The heel tip 12 may represent all degrees of wear, ranging from brand new to severely worn, where the bottom of the heel post 14 is exposed and mutilated from impact with the ground. In a severe degree of wear, the metal nail 28 is all that remains of the heel tip 12. The embodiments of the present invention attach over the lower part of the heel 16 and protect it from wear.

The heel protector of some of the embodiments includes a shielding cup 18, 18*a* comprising of flexible side walls 22 and attached to the heel 16 by a layer of adhesive 24, by radial force applied by tapering walls, or by an elongate self-fusing member 26. In some embodiments, the shielding cup 18, 18*a* attached to the heel 16 through use of a collapsible heat-concentrating accessory 30 and method of heat-shrinking said cup 18, 18*a* to the heel 16.

A. Shielding Cup Attached by an Elongate Member

The shielding cup 18, 18*a* may be formed of any suitable structural material such as hard rubber, plastic, and/or metal. Suitable materials include high-density polyethylene, polyurethane, polycarbonates, acrylonitrile butadiene styrene (ABS), or any abrasion resistant material. The shielding cup 18, 18*a* can be reinforced with another material such as a metal or another polymer. The base 20 of the cup 18, 18*a* is typically about 1 mm to about 4 mm in thickness and has a maximum width (e.g., diameter) ranging from about 7 mm to about 16 mm. The side walls 22 of the cup 18, 18*a* range from about 1 mm to about 3 mm in thickness and about 4 mm to about 12 mm in depth inside the cup. These dimensions cover the common range of stiletto heel tip sizes and are designed to emulate the appearance of a heel tip to avoid noticeability. The thickness of the side walls 22 may be uniform or tapered, for example, having a varying dimension along a direction that extends upwardly toward the open top of the shielding cup 18, 18*a*.

In one embodiment, the cup 18 has a depth from an open top to a substantially flat base inside the cup of between about 4 mm and about 8 mm, with straight side walls 22. In this embodiment, there preferably is one or more ridges on the exterior surface of at least a portion of the walls 22. Preferably this embodiment comprises polyurethane or other material having a hardness of about 90 shore A. This cup embodiment can be coupled with any of the elongate members described herein, which can be used to take up space between the cup 18 and the heel, to secure the cup 18 to the heel, or both to take up space and secure the cup 18 to the heel. In one embodiment, the cup 18 is provided with an elongate member that is between about 5 cm and about 10 cm long and that is between about 6 mm and about 25 mm wide.

Figure 2A:
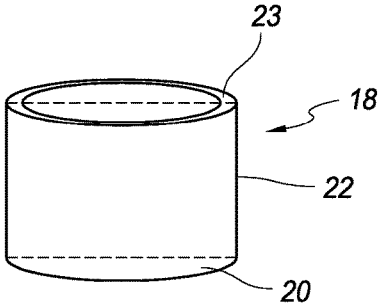
FIG. 2A is a perspective view of an embodiment of the shielding cup of the heel protector according to one embodiment of the invention.
Figure 2B:
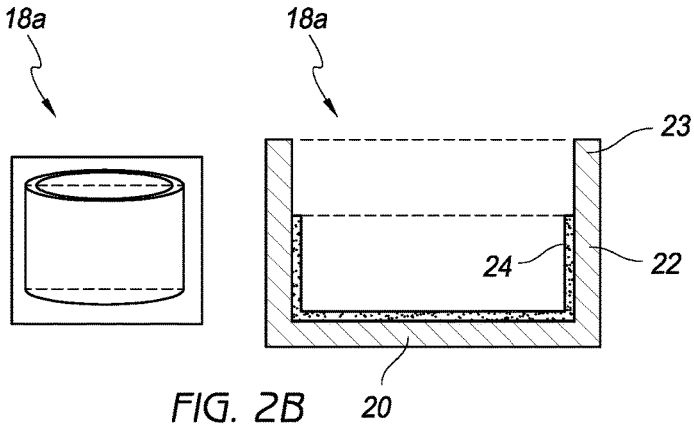
FIG. 2B is a perspective and cross sectional view of another embodiment of the shielding cup with an adhesive layer applied to the base and lower portion of the cup's side walls.
Figure 2C:
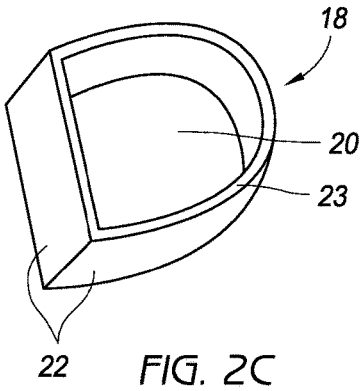
FIG. 2C is a top view of the base of the shielding cup shaped like a horseshoe, a common heel shape.

The cup 18, 18*a* includes a base 20 and side walls 22 which form a circle in FIGS. 2A and 2B but form a horseshoe or D-shape in FIG. 2C. The shielding cup 18, 18*a* is not limited to these two shapes, but varies to accommodate different heel shapes. The base 20 and side walls 22 of the shielding cup 18, 18*a* connect to form an open top with a top rim 23 and cavity for receiving the lower end of a heel 16. The base 20 of the cup 18, 18*a* may be flat or concave upward. The cup 18, 18*a* serves to provide a barrier between the heel 16 and ground, protecting the heel tip 12 or nail 28 from impact and abrasion caused by contact with the ground.

Figure 2D:
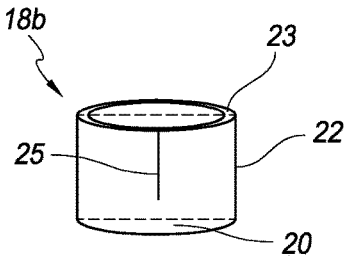
FIG. 2D is a perspective view of the shielding cup in FIGS. 2A and 2B, shown with slit(s) in the walls.
Figure 2E:
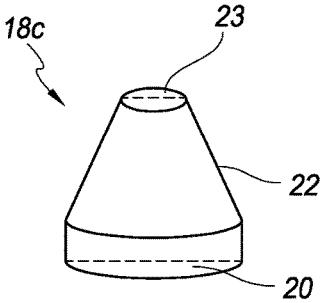
FIG. 2E is a side view of the shielding cup in FIGS. 2A and 2B, shown with the walls of the shielding cup tapering inward toward the center.
Figure 2F:
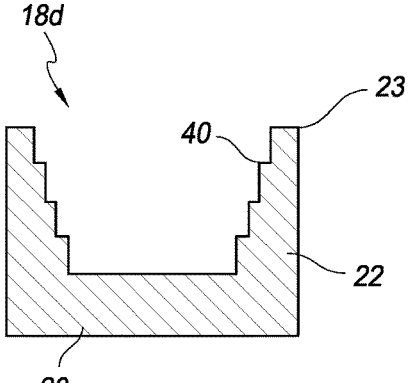
FIG. 2F is a cross sectional view of the shielding cup in FIGS. 2A and 2B, shown with the inner cavity of the shielding cup including steps.

In another embodiment shown in FIG. 2F, the inner cavity of the shielding cup 18*d* can comprise of steps 40 to further accommodate different heel sizes. Each level of steps 40 can form a perimeter conforming to the shape of the shielding cup 18*d* and gradually increases in perimeter as the steps 40 extend upward to the open top. Alternatively, steps 40 closer to the base 20 can have a shape conforming to the nail 28 or other internal structure and steps 40 closer to the top rim 23 can have a shape conforming to that of the top rim 23. The steps 40 collectively form a plurality of flat surfaces that are oriented to securely hold heels of different sizes. The flat steps 40 will allow the bottom of the heel 16 to stay parallel to the bottom base 20 of the cup 18*d*.

In the embodiment of FIG. 2D, the side walls 22 of the shielding cup 18*b* may have one or multiple slits 25 that run perpendicular or in an oblique manner to the base 20. These slit(s) 25 provide flexibility or slack to the upper portion of the cup so it can accommodate a range of heel sizes, including some sizes that are larger than an unexpanded size of the rim 23. The slit(s) 25 may be contiguous with the edge of the cup's top rim 23, e.g., having an upper end at the rim 23, a lower end disposed between the top rim 23 and the base 20 and a length there between. The length of the slit 25 can be between about 50% and about 75% of the depth of the cup 18. In other embodiments, the slit 25 can be disposed in between the top rim 23 and the base 20. The slits could also be deep enough to go through the thickness of the wall. In this case it is important to have enough strength in the wall to avoid premature rupture.

Figure 2G:
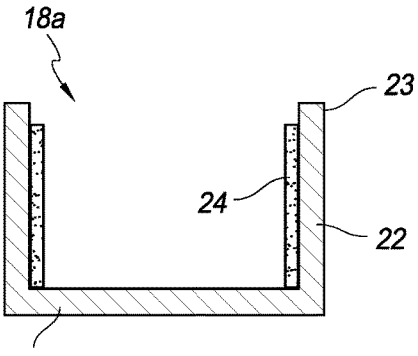
FIG. 2G is a cross sectional view of the shielding cup in FIGS. 2A and 2B, shown with the side walls covered with a layer of adhesive.
Figure 3A:
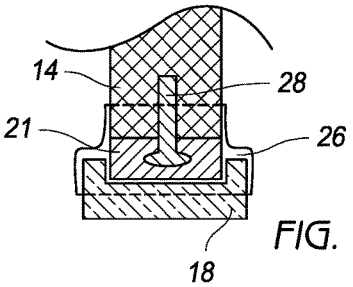
FIG. 3A is a cross sectional view of an embodiment of FIG. 2A or 2C attached to the lower part of the heel by an elongated self-fusing member.
Figure 3B:
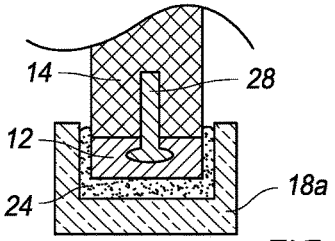
FIG. 3B is a cross sectional view of the shielding cup in FIGS. 2A and 2B attached to the lower part of the heel by an adhesive layer.

In other embodiments of the shielding cups 18, 18*a* shown in FIGS. 2B, 2G, and 3B, either the side walls 22 or both the side walls 22 and the base 20 may be covered with a layer of adhesive 24. The adhesive 24 extends upwardly from the base 20 to approximately one-half to the full height of the inner surface of the side wall 22.

In another embodiment shown in FIG. 2E, the shielding cup 18*c* has side walls 22 that taper or angle inward toward the center such that the diameter of the base 20 may be substantially larger than the relaxed diameter of the cup's top rim 23 but not substantially larger than the expanded diameter of the cup's top rim when a heel tip is inserted. The base 20 may be flat or concave upward as shown in FIG. 2I. The concave shape of the inside base 41 of shielding cup 18*f* accommodates heels with concave bases or extremely damaged heels that have an exposed nail.

The diameter of the cup's top rim 23 may be stretched to a diameter equivalent or greater than the diameter of the base 20. Inserting a heel tip 12 and/or heel post 14 with a diameter larger than the relaxed diameter of the cup's open rim 23 will constrict the cup 18*c* around the heel tip 12 and/or heel post 14, providing radial force to secure the cup 18*c* to the heel 16. In this embodiment shown in FIG. 2E, an elongate self-fusing member 26 may not be required to secure the cup 18*c* to the heel 16.

Figure 2H:
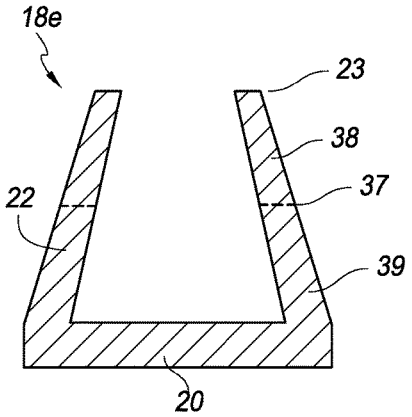
FIG. 2H is a cross sectional view of a variation of the shielding cup in FIGS. 2A, 2B, and 2E, shown with an upper portion of the side walls having a lower durometer than the lower portion of the side walls and base.
Figure 2I:
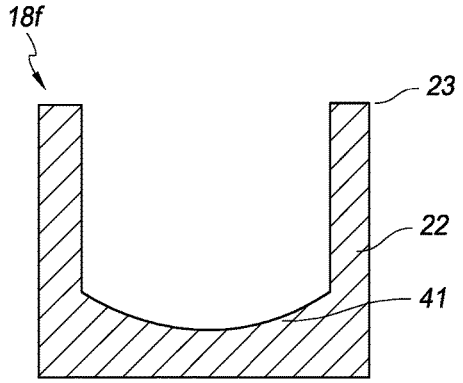
FIG. 2I is a cross sectional view of a variation of the shielding cup in FIGS. 2A and 2B, shown with an inside base with a concave surface.

In another embodiment shown in FIG. 2H, the shielding cup 18*e* has side walls 22 with a tapered upper portion 38. This upper portion 38 can have a lower durometer than the bottom portion 39 of the side walls 22 and base 20. The lower durometer provides more flexibility to the upper portion 38 of the cup 18*e* to accommodate different heel sizes. A transition line or zone 37 is provided between the lower durometer portion and a higher durometer portion disposed below the line or zone 37. The higher durometer portion is configured to be more robust and wear resistant. The lower durometer can be achieved by providing two materials with different durometers such as 90 shore A and 60 shore A, by mechanically changing the property of the upper section such as by reducing the thickness, or by other known techniques.

Figure 6:
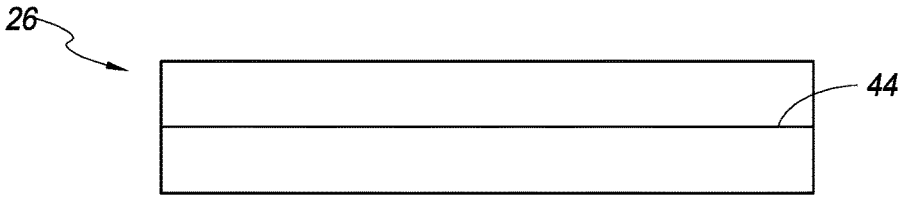
FIG. 6 is an elevational view of the elongate self-fusing member, shown with a guide line to indicate how to arrange it on the shielding cup and lower part of the heel.

In another embodiment shown in FIG. 3A, the shielding cup 18 is attached to the lower end of the heel by inserting the heel 16 into the cavity of the cup and securing it with an elongate self-fusing member 26. The self-fusing member 26 may be made of a self-fusing material, such as silicone, that readily binds to itself upon contact. In certain embodiments, the fusing is enhanced by cross-linking, which can be effectively provided when exposed to a catalyst. Other surface modifications such as plasma treatment or etching could also improve adhesion. The material does not damage the heel fabric after it is removed. The self-fusing member 26 may be attached to the cup 18, 18*a* or provided separately when assembled for commercial use. The cup 18, 18*a* is fastened to the lower end of the heel by stretching and contracting the self-fusing member 26 tightly around a portion of the cup 18, 18*a* and a portion of the heel 16 just above the top rim 23 of the cup 18, 18*a*. The self-fusing member 26 may have a visible guide line 44 shown in FIG. 6 to guide the user on how to divide the member between the cup 18, 18*a* and a portion of the heel 16 just above the top rim 23 of the cup 18, 18*a*. Also, the side walls 22 of the cup 18, 18*a* may have marks in the form of one or more lines to indicate where a portion of the self-fusing member should be positioned. The self-fusing member 26 applies a circumferential and radial force around the top rim 23 and side walls 22 of the cup 18, 18*a*, enclosing the shielding cup 18, 18*a* around the heel 16. In some embodiments, the radial force can be about 5 lbs or more. The radial force provided can range from about 5 lbs to about 30 lbs. In certain embodiments, the radial force can be about 30 lbs or more. In one embodiment, stretching the self-fusing member 26 activates the self-fusing or self adhering property of the material, e.g., by cross-linking, and allows it to create a strong, tight hold for the cup 18, 18*a* and heel 16. In one method, the self-fusing member 26 is wrapped around the heel 16 for several revolutions to achieve a secure attachment. In one embodiment, an interface between two portions of the member 26 is provided of at least one full perimeter of the heel 16 to provide a secure engagement. Preferably the self-fusing member 26 overlaps both the shielding cup 18, 18*a* and heel 16 for at least a portion of its length.

In one technique, the self-fusing member 26 can be wrapped around the lower portion of the heel 16 to create a greater heel perimeter. This minimizes any space between the enclosed heel 16 and inner perimeter of the cup 18, 18*a* before attachment. This technique can expand the variety of shoe configurations with which embodiments can be used. An adhesive layer 24, as previously described and shown in FIG. 3B, may be used to further secure the cup 18, 18*a* to the heel 16.

Figure 2J:
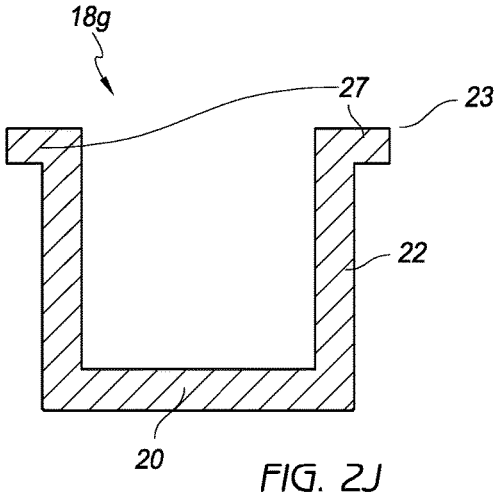
FIG. 2J is a cross sectional view of the shielding cup in FIGS. 2A and 2B, shown with an example of a friction-enhancing structure on the exterior side walls of the cup.
Figure 2K:
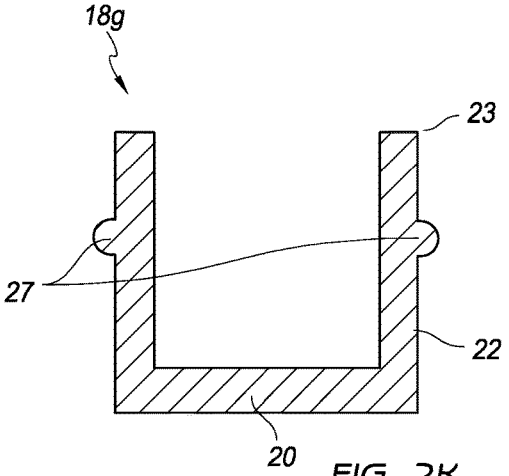
FIG. 2K is a cross sectional view of the shielding cup in FIGS. 2A and 2B, shown with another example of a friction-enhancing structure on the exterior side walls of the cup.

In another embodiment of the shielding cup 18*g* shown in FIGS. 2J and 2K, the outer portion of the side walls 22 of the cup may have ridges, grooves or any friction-enhancing surface to help grip and secure the inner surface of the elongate self-fusing member 26 to both an outer surface of the shoe 10 and side walls 22 of the cup. This prevents the self-fusing member 26 from slipping and loosening after attachment, especially when there is increased force on the cup 18 or the heel 16 such as when running, driving, or walking downhill. This friction-enhancing surface or structure 27 can be disposed on the same location, e.g., the same plane as the top rim 23 of the cup or in between the top rim 23 and the base 20. The friction-enhancing structure 27 can be in the form of protrusions (e.g., ridges, bumps or lips), depressions (e.g., groove or cuts), or any other surface deformations that promote friction. The height of the protrusions from the side wall(s) 22 of the cup to the crest of the protrusion can range from approximately 0.2 mm to 1 mm. The depth of the depressions from the side wall 22 to the bottom of the depression can range from approximately 0.05 mm to 0.75 mm. These structures 27 can have sharp or rounded edges and can be made of rigid or more flexible material. Additionally, the friction-enhancing surface can either be a uniform or randomly shaped structure(s) along the perimeter of the side wall(s) 22 of the cup 18.

The slits 25 previously discussed and shown in FIG. 2D may be used with the embodiment shown in FIG. 3A to enhance the flexibility of the upper portion of the cup 18*b* so it can accommodate a range of heel sizes. The slits 25 may be contiguous with the edge of the cup's top rim 23 or in between the edge of the top rim 23 and the base 20. Other techniques for enhancing the flexibility of an upper portion of the cup 18, 18*a* can also be used rather than the slits 25, such as using a low durometer material for the side walls 22.

B. Heat-Shrink Shielding Cup and Method for Attachment

Figure 4A:
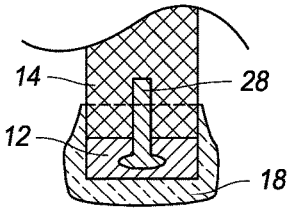
FIG. 4A is a cross sectional view of one embodiment of a cup structure configured to shrink into engagement with a lower part of the heel.
Figure 4B:
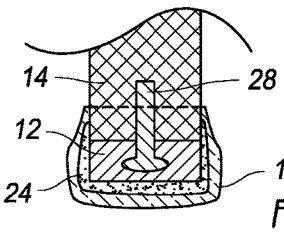
FIG. 4B is a cross sectional view of the shrinkable shielding cup embodiment in FIG. 4A, shown with an adhesive layer applied to the base and lower portions of the cup's side walls.

Another embodiment of the invention is illustrated in FIGS. 4A and 4B. The shielding cup 18, 18*a* is made of a heat-shrink material and attaches to the heel 16 by applying heat to the cup 18, 18*a*, thereby shrinking the cup to conform to the size and shape of the underlying heel 16. When heated, the heat-shrink cup 18, 18*a* creates a tight seal around the heel tip 12. The shrinking of the cup 18, 18*a* also provides a sufficient mechanical connection between the cup 18, 18*a* and the heel 16 to endure at least a short period of use, such as one or several days, until other more permanent repairs can be made. The heat shrinking embodiments can generate similar forces to those set forth above in connection with the use of the elongate self-fusing member 26.

The heat-shrink cup may be manufactured from a thermoplastic material such as polyolefin, fluoropolymer (such as FEP, PTFE or Kynar), PVC, polyvinyl chloride, neoprene, silicone elastomer or Viton. The shrink temperature of the cup 18, 18*a* is typically close to or at least 140 degrees Fahrenheit, or 60 degrees Celsius, so that a consumer is able to use this embodiment with a hot air hair dryer, a standard household good. Shrink tubing with higher temperatures are also possible and require heat sources with higher temperatures. The shrink ratio of the material preferably is about 3:1 but in some embodiments a ratio of about 2:1 is adequate. The thickness and height range of the walls can be identical to the previous embodiment. The base of the cup is typically about 1 mm to about 4 mm in thickness and has a diameter (or width) ranging from about 13 mm to about 22 mm. The thickness of the side walls 22 may be uniform or tapered, for example, having a varying dimension along a direction that extends upwardly toward the open top of the shielding cup 18, 18*a*. Additionally, the side walls 22 can taper or angle inward toward the center.

FIG. 4A shows the heat shrink cup 18, 18*a* attached to the heel tip 12 and the bottom portion of a heel post 14 after it has shrunk to its final configuration. An adhesive layer 24, as previously described, may be used to further secure the heat-shrink cup 18, 18*a* to the heel 16. FIG. 4B shows the heat-shrink embodiment similar to FIG. 4A, but with the adhesive layer 24.

Figure 5A:
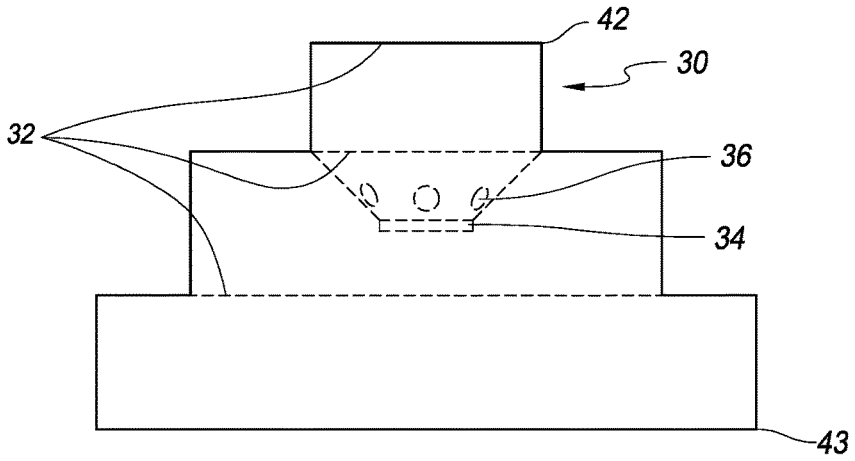
FIG. 5A is a perspective view of the collapsible heat-concentrating accessory in an expanded position.
Figure 5B:
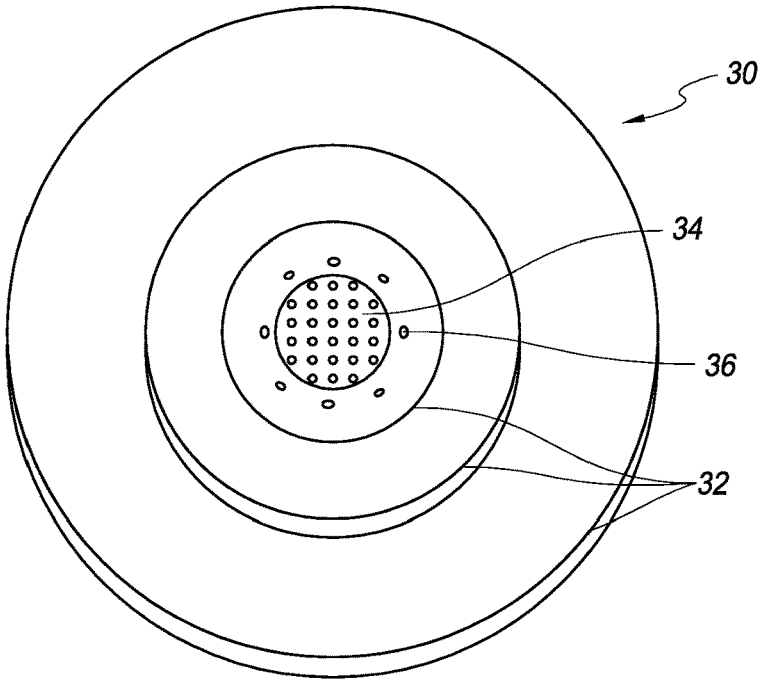
FIG. 5B is an elevational view of the collapsible heat-concentrating accessory in a collapsed position.

In the foregoing embodiments, the cup 18, 18*a* is configured to shrink upon application of heat. While this is a preferred configuration for shrinking the cup 18, 18*a* other modes for triggering and/or fully completing constriction of the cup 18, 18*a* onto the heel are possible; any heating source that will create a directed temperature of 60 degrees Celsius may be used. FIGS. 5A and 5B illustrate a collapsible heat-concentrating accessory 30 for directing heat at the cup 18, 18*a*. The accessory 30 can be used with a blow dryer. The accessory 30 can be used to concentrate hot air to achieve the minimum temperature required to activate the heat-shrink cup 18, 18*a*. The accessory 30 has an inverted narrow end 42 and is made of a flexible, heat-resistant material, such as silicone. The accessory 30 has concentric accordion pleats 32 allowing it to take on various configurations when expanded and collapsed. An expanded structure is illustrated in FIG. 5A and a collapsed structure is shown in FIG. 5B. Other heat sources such as radiation heating or other methods known to those skilled in the art are also possible.

As shown in FIG. 5A, the typical configuration of the collapsible heat-concentrating accessory 30 when expanded for heat-shrinking is a cone shape where the narrower half of the cone is folded into itself, forming a V-shape when viewed from the side. In use, the mouth of the blow dryer is placed in the wider opening 43 of the accessory 30, and when the blow dryer is switched on, the airflow is concentrated to the narrow opening 42 of the accessory 30.

The narrow opening 42 of the collapsible heat-concentrating accessory 30 has a mesh screen or crisscross pattern 34 in the material that can serve as a resting plate for the cup 18, 18*a* and a positioning device to prevent the cup 18, 18*a* from falling through the accessory 30. Additionally, the accessory 30 has air vents 36 surrounding the rim of the narrow opening 42 of the accessory 30 which are used to deliver heat higher up to the side wall(s) 22 of the cup 18, 18*a*. These air vents 36 allow the hot air to flow in a multidirectional pattern rather than solely in an upward direction from the narrow opening 42.

The heat shrink material is very durable after shrinking, providing a strong attachment to a heel, and is discreet because it conforms to a heel's shape and size. Additionally, the heat-shrink cup has a quick application time, such as less than a minute, and can potentially have a lifespan equivalent to that of a heel tip. For these reasons, this embodiment can rival a permanent heel tip replacement and potentially become the primary solution to heel tip replacement.

In various embodiments, the shielding cup may be circular, horseshoe, or any other shape given to high heels. Additionally, the shielding cup and elongate member may be made in different colors and may be decorated with designs such as logos or various black and white or colorful patterns.

What is claimed is:

1. A shielding cup configured to be attached to a stiletto heel tip, the cup comprising:

an open top;

a bottom base having an inner surface and an outer surface;

sidewalls extending from the bottom base to the open top, the sidewalls having an inner surface and an outer surface; and an inner cavity bounded by the inner surface of the sidewalls and the inner surface of the bottom base, the inner cavity configured to receive the heel tip through the open top, wherein a portion of the sidewalls adjacent to the open top is configured to be more flexible than a portion of the sidewalls adjacent to the bottom base by tapering the sidewalls from the bottom base to the open top such that a thickness as measured from the inner surface of the sidewall to the outer surface of the sidewall of the portion of the sidewalls adjacent to the open top is smaller than a thickness as measured from the inner surface of the sidewall to the outer surface of the sidewall of portion of the sidewalls adjacent to the bottom base, and wherein a size of the inner cavity adjacent to the open top is not greater than a size of the inner cavity adjacent to the bottom base in a relaxed configuration when the shielding cup is not attached to the heel tip.

2. The shielding cup of claim 1, wherein the open top has an outer perimeter not substantially smaller than an outer perimeter of the bottom base.

3. The shielding cup of claim 1, wherein the portion of the sidewalls adjacent to the open top has a durometer value less than a durometer value of a material of the shielding cup adjacent the bottom base.

4. The shielding cup of claim 1, wherein a depth of the inner cavity between an edge of the inner surface of the sidewalls adjacent the open top and an edge of the inner surface of sidewalls adjacent the bottom base is between about 4.0 mm and about 12.0 mm.

5. The shielding cup of claim 1, wherein the open top has an outer perimeter substantially smaller than an outer perimeter of the bottom base in a relaxed configuration when not attached to the heel tip.

6. The shielding cup of claim 1, wherein the thickness as measured from the inner surface of the sidewall to the outer surface of the sidewall of the portion of the sidewalls adjacent to the open top is configured such that a width of the open top can be varied to accommodate stiletto heel tips of different sizes.

7. A shielding cup configured to be attached to a stiletto heel tip, the cup comprising:

an open top having a first width in a first configuration when the cup is not attached to the heel tip and a second width in a second configuration when the cup is attached to the heel tip;

a bottom base having an inner surface and an outer surface, wherein a width of the inner surface of the bottom base is not substantially greater than the second width;

sidewalls extending from the bottom base to the open top, the sidewalls having an inner surface and an outer surface, the outer surface of the sidewalls being tapered along a longitudinal axis of the cup towards the open top such that a thickness, as measured from the inner surface of the sidewall to the outer surface of the sidewall, of the sidewalls adjacent the open top is smaller than a thickness, as measured from the inner surface of the sidewall to the outer surface of the sidewall, of the sidewalls adjacent the bottom base; and an inner cavity bounded by the inner surface of the sidewalls and the inner surface of the bottom base, the inner cavity configured to receive the heel tip through the open top, the inner cavity having a depth between the inner surface of the bottom base and the inner surface of the sidewalls adjacent the open top, wherein the sidewalls adjacent the open top are more flexible than the sidewalls adjacent the bottom base such that a heel tip having a width larger than the first width can be inserted into the inner cavity and secured by a force provided by the shielding cup along a direction perpendicular to the longitudinal axis of the cup, and wherein a size of the inner cavity adjacent to the open top is not greater than a size of the inner cavity adjacent to the bottom base in a relaxed configuration when the shielding cup is not attached to the heel tip.

8. The shielding cup of claim 7, wherein the depth of the cup is between about 4.0 mm and about 12.0 mm.

9. The shielding cup of claim 7, wherein the thickness of the sidewalls is between about 1.0 mm and about 3.0 mm.

10. The shielding cup of claim 7, wherein the width of the inner surface of the bottom base is between about 7.0 mm and about 16.0 mm.

11. The shielding cup of claim 7, comprising a polyurethane material having a hardness of 90 shore A or other abrasion resistant material.

12. The shielding cup of claim 7, wherein a material of the shielding cup adjacent the open top has a durometer value less than a durometer value of a material of the shielding cup adjacent the bottom base.

13. The shielding cup of claim 7, further comprising an adhesive disposed on the inner surface of the sidewalls, the inner surface of the bottom base, or both the inner surface of the sidewalls and the inner surface of the bottom base.

14. The shielding cup of claim 7, wherein the open top has an outer perimeter not substantially smaller than an outer perimeter of the bottom base.

15. The shielding cup of claim 7, wherein the open top has an outer perimeter substantially smaller than an outer perimeter of the bottom base in a relaxed configuration when not attached to the heel tip.

16. A method for repairing a stiletto heel having a heel tip disposed at the end of a heel post, the heel post having a first end coupled with the stiletto shoe and a second end adjacent to the tip, the method comprising:

providing a shielding cup comprising a bottom base of durable, abrasion-resistant material, side walls extending away from the bottom base to an open top having a first width in a first configuration when the cup is not attached to the heel tip and a second width in a second configuration when the cup is attached to the heel tip, a portion of the sidewalls adjacent to the open top being configured to be more flexible than a portion of the sidewalls adjacent to the bottom base by tapering the sidewalls from the bottom base to the open top such that a thickness of the portion of the sidewalls adjacent to the open top is smaller than a thickness of portion of the sidewalls adjacent to the bottom base; and placing the shielding cup over the heel tip, or placing the shielding cup over the heel tip and a portion of the heel post such that the heel tip is covered and the open top is disposed between the first and second end of the heel post at a location closer to the second end of the heel post than the first end of the heel post, wherein, the first width of the open top is configured to be smaller than a width of the heel tip and/or a portion of the heel post such that the portion of the sidewalls adjacent to the open top is configured to expand to receive the heel tip and/or the portion of the heel post, wherein the shielding cup is configured to constrict around the heel tip and/or the portion of the heel post when placed over the heel tip, or over the heel tip and the portion of the heel post thereby providing radial forces to secure the shielding cup, and wherein a size of the inner cavity adjacent to the open top is not greater than a size of the inner cavity adjacent to the bottom base in a relaxed configuration when the shielding cup is not attached to the heel tip.

17. The method of claim 16, wherein the thickness of the portion of the sidewalls adjacent to the open top is configured such that the first width of the open top can be varied to accommodate heel tips and/or heel posts of different sizes.

* * * * *